US011571923B2

(12) United States Patent
Michenaud et al.

(10) Patent No.: US 11,571,923 B2
(45) Date of Patent: Feb. 7, 2023

(54) WRITING INSTRUMENT COMPRISING A CLIP AND A RETRACTABLE ERASER DEVICE

(71) Applicant: SOCIETE BIC, Clichy (FR)

(72) Inventors: Etienne Michenaud, Montrouge (FR); Franck Vadenne, Bezons (FR); Aurélien Coffinet, Epone (FR)

(73) Assignee: SOCIÉTÉ BIC, Clichy (FR)

( * ) Notice: Subject to any disclaimer, the term of this patent is extended or adjusted under 35 U.S.C. 154(b) by 0 days.

(21) Appl. No.: 17/046,455

(22) PCT Filed: Apr. 4, 2019

(86) PCT No.: PCT/FR2019/050789
§ 371 (c)(1),
(2) Date: Oct. 9, 2020

(87) PCT Pub. No.: WO2019/197756
PCT Pub. Date: Oct. 17, 2019

(65) Prior Publication Data

US 2021/0146714 A1 May 20, 2021

(30) Foreign Application Priority Data

Apr. 11, 2018 (FR) ..... 1853155

(51) Int. Cl.
*B43K 25/02* (2006.01)
*B43K 29/02* (2006.01)

(52) U.S. Cl.
CPC ..... *B43K 25/026* (2013.01); *B43K 29/02* (2013.01)

(58) Field of Classification Search
CPC ..... B43K 25/026; B43K 29/02; B43K 21/06; B43L 19/005; B43L 19/0056; B43L 19/0068; B43L 19/0075; B43L 19/0081
See application file for complete search history.

(56) References Cited

U.S. PATENT DOCUMENTS

| | | | | |
|---|---|---|---|---|
| 1,473,090 A | | 11/1923 | Ferry | |
| 2,075,932 A | * | 4/1937 | Ehrmann | B43K 29/18 407/29.15 |
| 3,756,727 A | * | 9/1973 | Gallagher | B43K 21/006 401/84 |
| 4,899,419 A | * | 2/1990 | Saleen | B43K 29/02 15/428 |
| 5,855,442 A | | 1/1999 | Keller | |
| 6,979,142 B1 | * | 12/2005 | Chmelar | B43K 21/003 401/65 |
| 9,108,456 B2 | * | 8/2015 | Ito | B43K 7/005 |

FOREIGN PATENT DOCUMENTS

DE 202012001422 U1 6/2012

OTHER PUBLICATIONS

International Search Report issued in International Application PCT/FR2019/050789 dated Jun. 26, 2019, with English translation (2 pages).

* cited by examiner

*Primary Examiner* — David P Angwin
*Assistant Examiner* — Bradley S Oliver
(74) *Attorney, Agent, or Firm* — Bookoff McAndrews, PLLC

(57) ABSTRACT

Writing instrument having a body, a clip, and a retractable eraser device movable between a first position and a second position, the clip forming a housing that is designed to receive all or part of a gripping portion of the eraser device in the first position.

20 Claims, 3 Drawing Sheets

WRITING INSTRUMENT COMPRISING A CLIP AND A RETRACTABLE ERASER DEVICE

CROSS REFERENCE TO RELATED APPLICATION(S)

This application is a National Stage Application of International Application No. PCT/FR2019/050789, filed on Apr. 4, 2019, now published as WO2019/197756 and which claims priority to French Application No. FR1853155, filed on Apr. 11, 2018.

TECHNICAL FIELD

This disclosure relates to a writing instrument that is equipped with a clip and a retractable eraser device.

BACKGROUND

Writing instruments that comprise a retractable eraser device are known. However, these known writing instruments are not always very ergonomic, and their aesthetics are sometimes questionable, so that their sales potential remains reduced despite their intrinsic qualities. A need thus exists in this regard.

SUMMARY

One embodiment relates to a writing instrument having a body, a clip, and a retractable eraser configured to be moved between a first position and a second position, the clip forming a housing that is configured to receive all or part of a gripping portion of the eraser device in the first position.

As is understood, the body may be formed from one and the same part or include a plurality of parts. It is also understood that the clip may form one and the same part with the body or a portion of the body, or else it may be a separate part of the body and mounted on the body.

It is understood that the eraser device is configured to erase writing from graphite pencils, colored pencils, waxes, inks, etc. According to a variant, the eraser device comprises a friction body that is configured to be rubbed on a surface, for example in order to generate heat and cause a thermochromic ink—that is, an ink that changes color as a function of the heat to which it is subjected—to change color.

The eraser device may be moved between the first position and the second position. In order to move it from the first position to the second position and vice versa, the eraser device is provided with a gripping portion that may be easily manipulated by a user for this purpose.

The clip includes a housing that is configured to receive at least part of the gripping portion when the eraser device is in the first position. As is understood, a portion of the eraser device other than the gripping portion may be received in the housing of the clip when the eraser device is in the first position, but not necessarily. Likewise, the gripping portion may extend partially into the housing of the clip when the eraser device is in the second position, but not necessarily. One example is when the housing is open and allows access to the gripping portion from outside the writing instrument. For example, the first position is a retracted position of the eraser device in which the eraser device cannot be used, or only with difficulty (i.e., the protective position), while the second position is an extended position of the eraser device in which the eraser device is able to be used (i.e., the erasing position). As is understood, according to a variant the first position corresponds to the extended position, whereas the second position corresponds to the retracted position.

It has been found that the writing instrument and its eraser device are rendered particularly ergonomic by placing the gripping portion in a housing of the clip. Moreover, by integrating at least part of the gripping portion in a housing of the clip at least in the first position, the general shape of the writing instrument is more harmonious, thus providing a favorable aesthetic.

In some embodiments, the body extends in an axial direction, in which case the eraser device can be moved in the axial direction and the eraser device projects axially from an axial end of the body in the second position, whereas it does not protrude axially from the body in the first position.

In general, the axial direction corresponds to the direction of the axis of the body, and a radial direction is a direction perpendicular to the axis of the body. It is understood that an azimuthal or circumferential direction corresponds to the direction describing a ring around the axial direction. It is also understood that the body has a first axial end and a second axial end that opposes the first axial end in the axial direction. In the second position, the eraser device projects axially from the body from the first axial end or from the second axial end.

The eraser device may be moved in the axial direction between the first position and the second position. According to a first variant, the movement of the eraser device between these two positions is strictly axial. According to a second variant, the movement of the eraser device between these two positions comprises an axial component and an additional component that is radial and/or azimuthal, for example.

In general, a writing instrument clip extends in the axial direction of the body of the writing instrument. Such axial movement of the eraser device, and therefore of the gripping portion, provides for good ergonomics and allows harmonious integration of the gripping portion within the clip, thus providing a favorable aesthetic.

In some embodiments, the eraser device is partially retracted into the body in the first position.

It is therefore understood that the body receives a portion of the eraser device at least in the first position. In other words, a portion of the eraser device is retracted into the body at least in the first position. The portion of the eraser device that is placed inside the body is thus protected by the body from external aggressions and dirt. Furthermore, by accommodating a portion of the eraser device in the body in the first position, the eraser device is partially integrated into the body, which makes it possible to obtain a general shape of the harmonious writing instrument, providing a favorable aesthetic.

In some embodiments, the clip and/or the body includes a guide that is designed to guide the eraser device between the first position and the second position.

For example, the guide comprises a groove or a rib that is designed to cooperate in a sliding manner with a rib or a groove of the eraser device, for example in the axial direction.

Such a guide makes it possible to assist the user during the movement of the eraser device between the first position and the second position. Such a guide is ergonomically favorable while ensuring the correct positioning of the eraser device in the first and in the second position, which is aesthetically favorable.

In some embodiments, the eraser device and/or the clip and/or the body includes at least one retaining element that is designed to retain the eraser device in the first position.

For example, the retaining element comprises a clipping relief, for example a boss, a tooth, a tongue, a concavity, etc.

Such a retaining element makes it possible to retain the eraser device in the first position when it is subjected to its own weight in the axial direction, for example, but allows it to move into the second position when a user applies a force that is greater than or equal to a predetermined force. Such a retaining element makes it possible to prevent the eraser device from inadvertently moving from the first position to the second position, which is ergonomically favorable, and makes it possible to ensure a generally stable shape in the first position, which is aesthetically favorable.

In some embodiments, the eraser device and/or the clip and/or the body includes at least one holding element that is designed to hold the eraser device in the second position.

For example, the retaining element and the holding element may be formed by one and the same element. For example, the holding element comprises a clipping relief—for example a boss, a tooth, a tongue, a concavity, etc.

Such a holding element makes it possible to maintain the eraser device in the second position, for example when it is subjected to its own weight in the axial direction in a direction tending to move it away from the first position, but allows it to move into the first position. Such a holding element makes it possible to prevent the eraser device from unintentionally disassembling from the body, which is ergonomically favorable, and makes it possible to ensure a generally stable shape in the second position, which is aesthetically favorable.

In some embodiments, the clip has a "V"- or "U"-shaped portion forming the housing, in which case the gripping portion is received in the concavity of the "V" or "U" when the eraser device is in the first position.

For example, the two vertical branches of the "U" or of the "V" form the base of the body of the clip, the clip being fixed to the body via the free end of these two branches. It is understood that the space that is formed between these two branches forms a housing, the gripping portion being received in whole or in part in this housing between the two branches in the first position. Such a configuration allows for ergonomic integration of the gripping portion relative to the clip, and, in the first position, provides a generally harmonious shape that is aesthetically favorable.

In certain embodiments, the clip conforms to the gripping portion when the eraser device is in the first position, with the clip and the gripping portion cooperating by complementarity of shape.

In other words, the part of the gripping portion that cooperates with the clip has a shape that is complementary to the part of the clip with which it cooperates. Such a configuration allows for ergonomic integration of the gripping portion relative to the clip, and, in the first position, provides a generally harmonious shape that is aesthetically favorable.

In some embodiments, the eraser device includes an eraser holder and an eraser that is carried by the eraser holder.

In certain embodiments, the eraser device is formed by one and the same part.

This allows for better integration of the eraser device. This also makes it possible to achieve a certain visual effect as a function of the colors that are used for the manufacture of the eraser device.

In some embodiments, the body extends in an axial direction, in which case the writing instrument comprises a writing tip that is oppositely situated in the axial direction of the eraser device.

Such a configuration is very ergonomic and provides a general shape of the harmonious writing instrument that is aesthetically favorable.

In some embodiments, the eraser device includes a friction body that is designed to be rubbed against a surface that is coated with thermochromic ink in order to generate heat and cause the thermochromic ink to change color.

The writing instrument according to the present disclosure is particularly well suited for such a friction body.

BRIEF DESCRIPTION OF THE DRAWINGS

The subject matter of this disclosure and its advantages will be better understood on reading the detailed description given below of various embodiments given by way of non-limiting examples. This description refers to the pages of attached figures, on which.

DETAILED DESCRIPTION

Figure 1A:
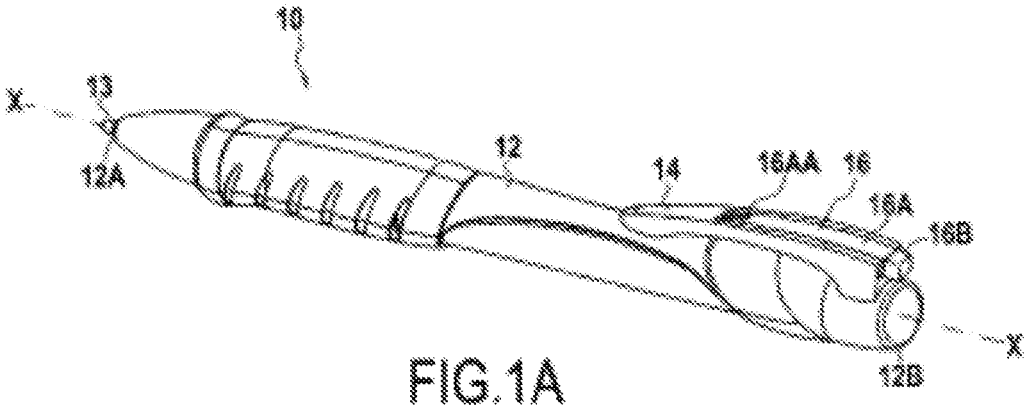
FIGS. 1A, 1B, and 1C show a first embodiment of a writing instrument as respectively seen in a state in which the eraser device is in the first position, in a state in which the eraser device is in the second position, and in an exploded view.

A writing instrument 10 according to a first embodiment is described with reference to FIGS. 1A to 1C. The writing instrument 10 comprises a body 12 that extends in an axial direction X, a clip 14, and a retractable eraser device 16. In this example, the body 12 is made from one and the same part, while the clip 14 is fixed elsewhere to the body 12 by known means. The eraser device 16 is disposed on the side of a second axial end 12B of the body 12. The writing instrument 10 comprises a writing tip 13—in this example a fixed ball point—that is arranged at a first axial end 12A of the body 12 in the opposite direction in the axial direction X of the second axial end 12B. The writing tip 13 is oppositely situated in the axial direction X of the eraser device 16.

Figure 1B:
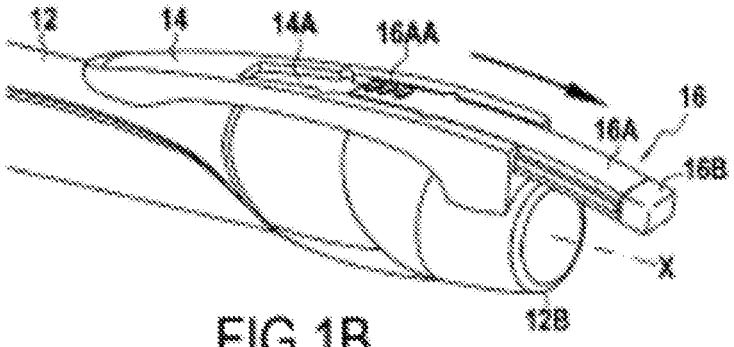
Figure 1C:
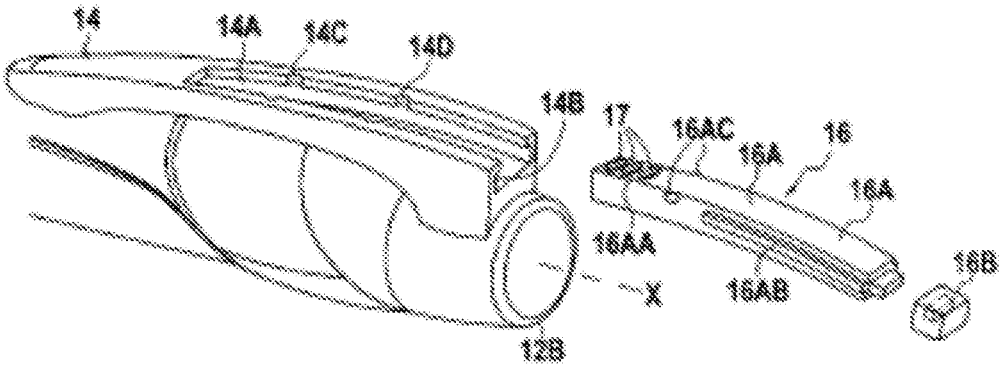

The eraser device 16 may be moved axially between a first position (see FIG. 1A) and a second position (see FIG. 1B). In this example, the first position is a retracted position of the eraser device in which the eraser device cannot be used, or only with difficulty (i.e., the protective position), while the second position is an extended position of the eraser device in which the eraser device is able to be used (i.e., the erasing position). More particularly, in this example, the eraser device 16 projects axially from the second axial end 12B in the second position, whereas it does not project axially from the second axial end 12B in the first position.

The eraser device 16 comprises an eraser holder 16A and an eraser 16B that is carried by the eraser holder 16A. As is understood, the eraser 16B is designed to erase the writing produced by the writing tip 13 and may, for example, be an eraser for peelable ink or a friction body for thermochromic ink. As is understood, the nature of the eraser varies depending on the nature of the writing tip (ball point, felt, pencil, graphite pencil, wax, etc.).

The eraser holder 16A has the general shape of a tongue that extends axially and has gripping reliefs 17 on an exposed face. The portion 16AA of the eraser holder 16A carrying the reliefs 17 forms a gripping portion. This gripping portion 16AA is received in a housing 14A of the clip 14 both in the first position and in the second position. Note that the housing 14A is a radially open housing that allows access to the gripping portion 16AA from the outside of the writing instrument 10, and that it has a "U" shape, the gripping portion 16AA being received inside the "U" shape. As shown in FIG. 1A, the gripping portion 16AA conforms to the shape of the clip 14, and more particularly the contour of the housing 14A, by complementarity when in the first position.

In this example, the eraser 16B is outside the housing 14A and the body 12 regardless of the position of the eraser device 16. In particular, in the first position, the eraser 16B does not protrude axially from the body 12 (i.e., it remains below the second axial end 12B or at most at the same level in the axial direction as the second axial end 12B) and is arranged axially between the clip 14 and the second axial end 12B.

The eraser holder 16A has two axial ribs 16AB, each of which cooperates in the manner of a slide with a guide of the clip 14in this example an axial groove 14B. The eraser holder 16A comprises two reliefs 16AC, each of which cooperates in the first position with a relief 14C and in the second position with a relief 14D of the clip 14. The reliefs 16AC and 14C thus form elements for retaining the eraser device 16 in the first position, while the reliefs 16AC and 14D form elements for maintaining the eraser device in the second position. In this example, the reliefs 16AC are pins, whereas the reliefs 14C and 14D are depressions, but it is understood that an inverse structure is possible.

In the first position, the reliefs 16AC are thus engaged with the reliefs 14C such that the eraser device 16 remains in the first position. In order to bring it into the second position, the user pushes the eraser device 16 via the gripping portion 16AA according to the arrow in bold in FIG. 1B until the reliefs 16AC are engaged with the reliefs 14D. The eraser device 16 is thus maintained in the second position. In order to return the eraser device 16 to the first position, the reverse operation is carried out, namely the eraser device 16 is pushed in the opposite direction of the arrow in bold in FIG. 1B.

A writing instrument 100 according to a second embodiment is be described with reference to FIGS. 2A to 2D. The writing instrument 100 comprises a body 112 that extends in an axial direction X, a clip 114, and a retractable eraser device 116. In this example, the body 112 comprises two separate assembled parts 112-I and 112-II, the clip 114 forming one and the same part with the part 112-II. The eraser device 116 is disposed on the side of a second axial end 112B of the body 112. The writing instrument 100 comprises a writing tip 113—in this example a fixed ball point—that is arranged at a first axial end 112A of the body 112 in the opposite direction in the axial direction X of the second axial end 112B. The writing tip 113 is oppositely situated in the axial direction of the eraser device 116.

Figure 2A:
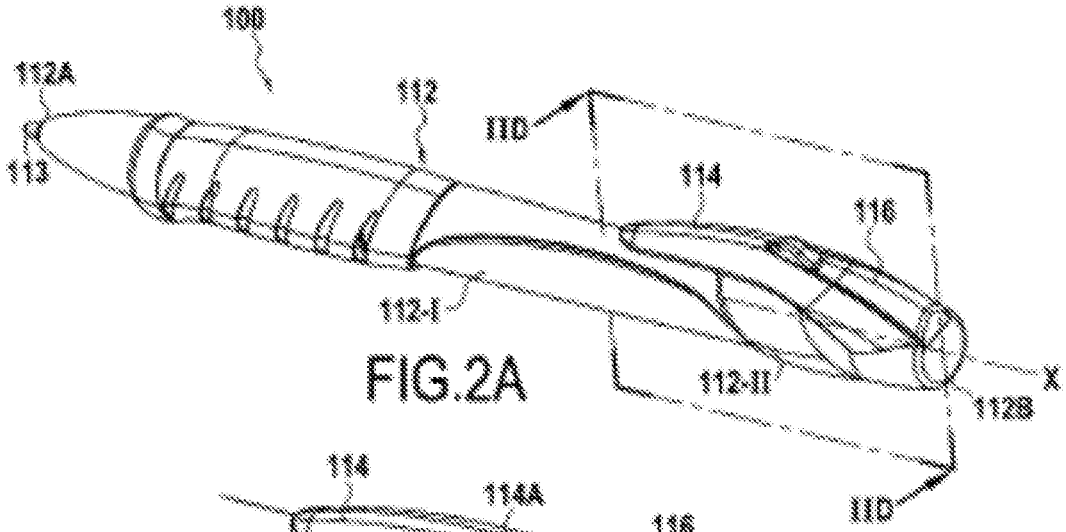
FIGS. 2A, 2B, 2C, and 2D show a second embodiment of a writing instrument as respectively seen in a state in which the eraser device is in the first position, in a state in which the eraser device is in the second position, in an exploded view, and in section along plane IID of FIG. 2A, and FIGS. 3A, 3B, 3C, and 3D show a third embodiment of a writing instrument as respectively seen in a state in which the eraser device is in the first position, in a state in which the eraser device is in the second position, in an exploded view, and in section along plane IIID of FIG. 3B.
Figure 2B:
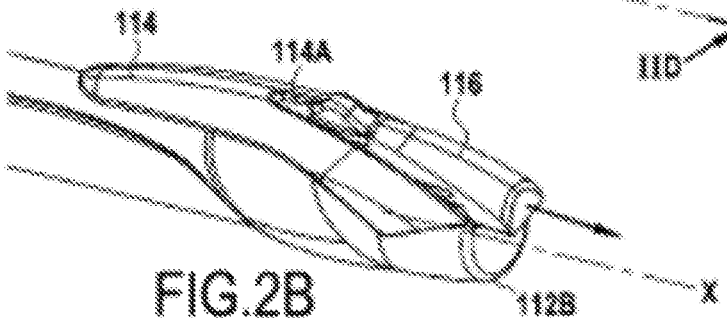
Figure 2C:
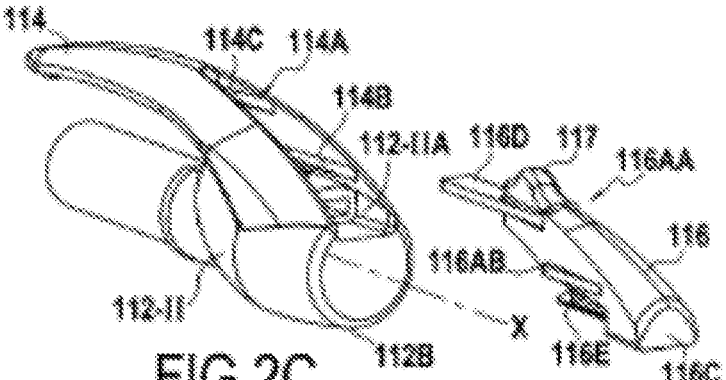
Figure 2D:
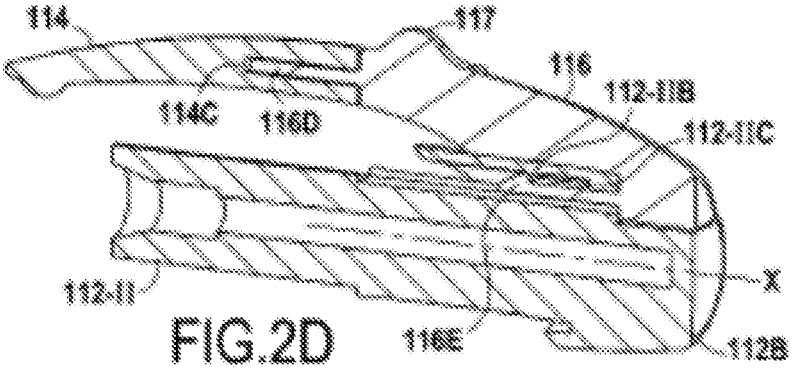

The eraser device 116 may be moved axially between a first position (see FIG. 2A) and a second position (see FIG. 2B). In this example, the first position is a retracted position of the eraser device in which the eraser device cannot, or with difficulty, be used (i.e., the protection position) while the second position is an extended position of the eraser device in which the eraser device may be used (i.e., the erasing position). More particularly, in this example, the eraser device 116 projects axially from the second axial end 112B in the second position, whereas it does not project axially from the second axial end 112B in the first position.

The eraser device 116 is formed from one and the same part. Such a configuration is particularly well suited for forming a friction body for thermochromic ink, with the distal end of the eraser device 116 forming an erasing portion. It is understood that, according to one variant, the eraser device 116 may be composed of two parts and comprise an eraser holder and an eraser.

The eraser device 116 has a gripping relief 117 on an exposed face. The portion 116AA of the eraser device 116 carrying the relief 117 forms a gripping portion. This gripping portion 116AA is received in a housing 114A of the clip 114 in the first position. Note that the housing 114A is a radially open housing that allows access to the gripping portion 116AA from the outside of the writing instrument. As shown in FIG. 2A, the gripping portion 116AA conforms to the shape of the clip 114, and more particularly the contour of the housing 114A, by complementarity when in the first position.

The base of the clip 114—i.e., the portion by means of which the clip 114 is connected to the body 112—has a "V" shape, the clip 114 being fixed to the body via the free ends of the two vertical branches of the "V" shape. The concavity formed in the hollow of the "V" shape forms the housing 114A (see FIGS. 2B and 2C) and receives the gripping part 116AA in the first position (see FIG. 2A).

In this example, the eraser device 116 is partially retracted into the body 112 in the first position. To wit, the body 112, and more particularly the part 112-II, comprises a housing 112-IIA that receives a portion 116C of the eraser device 116 in the first position (see FIGS. 2A and 2C).

The eraser device 116 has two axial ribs 116AB, each of which cooperates in the manner of a slide in a guide of the clip 114—in this example an axial groove 114B—as well as an axial tongue 116D that cooperates in the manner of a slide in another guide of the clip 114in this example an axial slot 114C. These two guides are parallel in the axial direction X and, in particular, limit the rotational movements around a direction perpendicular to the axial direction that would risk blocking the blocking device 116 during the movement of the latter between the first position and the second position.

The eraser device 116 comprises a clipping tab 116E that cooperates with a clipping relief 112-IIB in the first position and with a shoulder 112-IIC of the body 112, and more particularly of the part 112-II, in the second position. The tab 116E and the relief 112-IIB thus form elements for retaining the eraser device 116 in the first position, while the tab 116E and shoulder 112-IIC form elements for maintaining the eraser device 116 in the second position.

Thus, in the first position, the tab 116E is engaged with the relief 112-IIB such that the eraser device 116 remains in position. In order to bring it into the second position, the user pushes the eraser device 116 via the gripping portion 116AA according to the arrow in bold in FIG. 2B until the tab 116E cooperates with the shoulder 112-IIC. The eraser device 116 is thus maintained in the second position. In order to return the eraser device 116 to the first position, the reverse operation is carried out, namely the eraser device 116 is pushed in the opposite direction of the arrow in bold in FIG. 2B.

A writing instrument 200 according to a third embodiment is be described with reference to FIGS. 3A to 3D. The writing instrument 200 comprises a body 212 that extends in an axial direction X, a clip 214, and a retractable eraser device 216. In this example, the body 212 comprises two separate assembled parts 212-I and 212-II, the clip 214 forming one and the same part with the part 212-II. The eraser device 216 is disposed on the side of a second axial end 212B of the body 212. The writing instrument 200 comprises a writing tip 213—in this example a retractable ball point—that is arranged at a first axial end 212A of the body 212 in the opposite direction in the axial direction X of the second axial end 212B. The writing tip 213 is arranged opposite in the axial direction of the eraser device 216. In this example, the writing tip 213 may be retracted by virtue of a button 215 that is designed to actuate an otherwise known retraction mechanism and housed in the body 212.

Figure 3A:
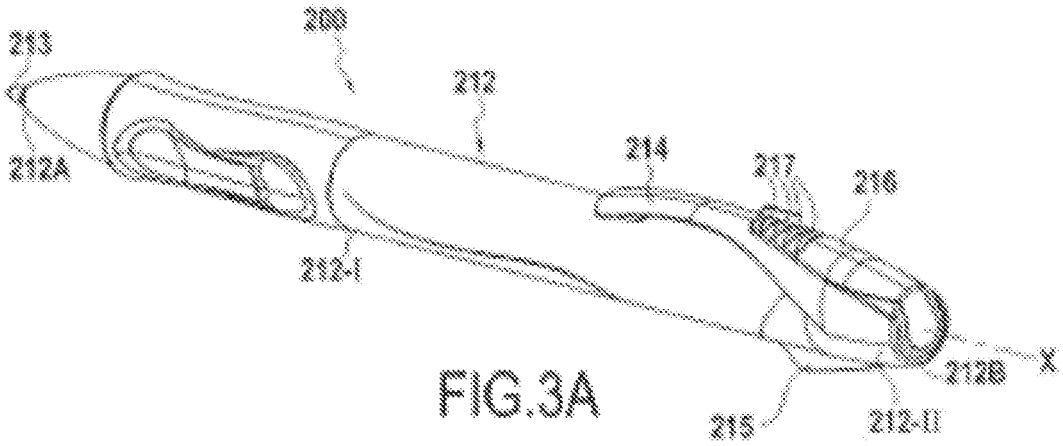
Figure 3B:
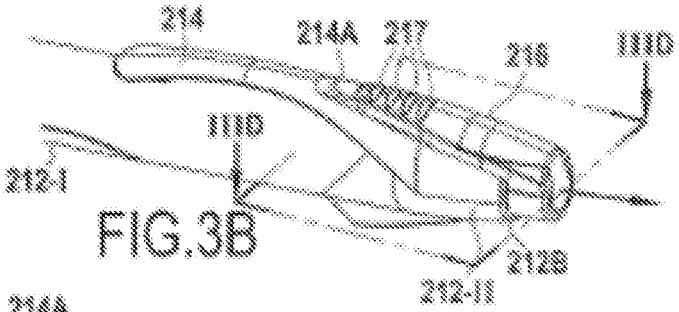
Figure 3C:
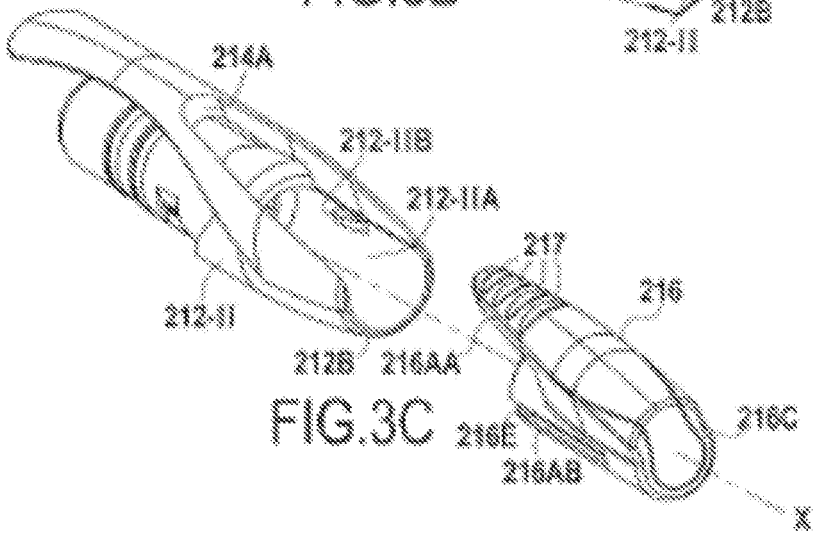
Figure 3D:
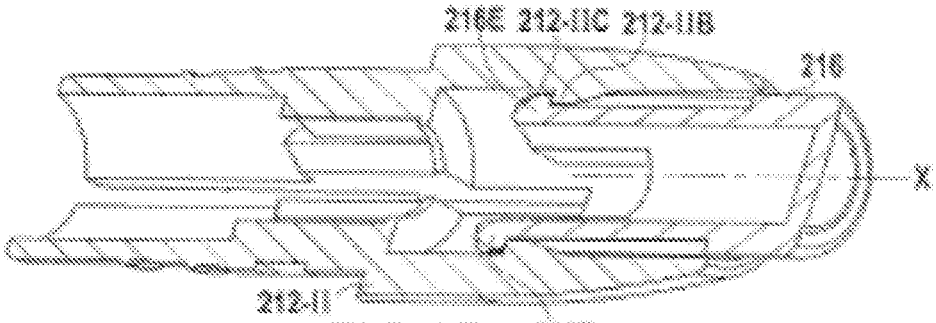

The eraser device 216 may be moved axially between a first position (see FIG. 3A) and a second position (see FIG. 3B). In this example, the first position is a retracted position of the eraser device in which the eraser device cannot, or with difficulty, be used (i.e., the protection position), while the second position is an extended position of the eraser device in which the eraser device may be used (i.e., the erasing position). More particularly, in this example, the eraser device 216 projects axially from the second axial end 212B in the second position, whereas it does not project axially from the second axial end 212B in the first position.

The eraser device 216 is formed from one and the same part. Such a configuration is particularly well suited for forming a friction body for thermochromic ink, with the distal end of the eraser device 216 forming an erasing portion. It is understood that, according to one variant, the eraser device 216 may be composed of two parts and comprise an eraser support and an eraser.

The eraser device 216 has gripping reliefs 217 on an exposed face. The portion 216AA of the eraser device 216 carrying the reliefs 217 forms a gripping portion. This gripping portion 216AA is received in a housing 214A of the clip 214 in the first position. Note that the housing 214A is a radially open housing that allows access to the gripping portion 216AA from the outside of the writing instrument. As shown in FIG. 3A, the gripping portion 216AA conforms to the shape of the clip 214, and more particularly the contour of the housing 214A, by complementarity when in the first position.

The base of clip 214—i.e., the portion by means of which the clip 214 is connected to body 212—has a "U" shape, with the clip 214 being secured to body 212 via the free ends of the two vertical branches of the "U" shape. The concavity formed in the hollow of the "U" shape forms the housing 214A (see FIGS. 3B and 3C) and receives the gripping part 216AA in the first position (see FIG. 3A).

In this example, the eraser device 216 is partially retracted into the body 212 in the first position. To wit, the body 212, and more particularly the part 212-II, comprises a housing 212-IIA that receives a portion 216C of the eraser device 216 in the first position (see FIGS. 3A and 3C).

The eraser device 216 has two axial grooves 216AB, each of which cooperates in the manner of a slide with a guide of the body 212—in this example an axial rib 212-IIB.

The eraser device 216 comprises a stop 216E that cooperates with a shoulder 212-IIC of the body 112, and more particularly of the part 112-II, in the second position. In this example, the stop 216E is disposed more particularly in the groove 216AB and cooperates with an axial end of the axial rib 212-IIB that forms the shoulder 212-IIC. The stop 216E and the shoulder 212-IIC thus form elements for maintaining the eraser device 216 in the second position.

Thus, in order to bring the eraser device into the second position from the first position, the user pushes the eraser device 216 via the gripping portion 216AA according to the arrow in bold in FIG. 3B until the stop 216E abuts against the shoulder 212-IIC. The eraser device 216 is thus maintained in the second position. In order to return the eraser device 216 to the first position, the reverse operation is carried out, namely the eraser device 216 is pushed in the opposite direction of the arrow in bold in FIG. 3B.

Although this disclosure has been described with reference to specific embodiments, it is obvious that modifications and changes can be made to these examples without departing from the general scope as defined by the claims. In particular, individual features of the various illustrated/mentioned embodiments can be combined in additional embodiments. Therefore, the description and the drawings should be considered in an illustrative rather than restrictive sense.

The invention claimed is:

1. A writing instrument, having a body, a clip, and a retractable eraser device configured to be moved between a first position and a second position, the clip forming a housing that is designed to receive all or part of a gripping portion of the eraser device when the eraser device is in the first position, and the clip and/or the body comprising an opening, an interior wall that extends transversely from a plane of the opening, and a guide that is designed to guide the eraser device between the first and second positions, the guide comprising a channel or axial ribs extending from the first position to the second position corresponding to complementary axial ribs or a complementary channel of the eraser device, wherein the channel or axial ribs extend along the interior wall.

2. The writing instrument according to claim 1, wherein the body extends in an axial direction, the eraser device being movable in the axial direction, and the eraser device projecting axially from an axial end of the body when the eraser device is in the second position while not projecting axially from the body when the eraser device is in the first position.

3. The writing instrument according to claim 1, wherein the eraser device is partially retracted into the body in the first position.

4. The writing instrument according to claim 1, wherein the eraser device and/or the clip and/or the body comprises at least one retainer that is designed to retain the eraser device in the first position.

5. The writing instrument according to claim 1, wherein the eraser device and/or the clip and/or the body comprises at least one holder that is designed to maintain the eraser device in the second position.

6. The writing instrument according to claim 1, wherein the clip has a "V" or "U" shaped portion that forms the housing, wherein the "V" or "U" shaped portion includes a concavity, and wherein the gripping portion is received in the concavity of the "V" or "U" shaped portion when the eraser device is in the first position, the concavity being open at an axial end of the body.

7. The writing instrument according to claim 1, wherein the clip conforms to the gripping portion when the eraser device is in the first position, with the clip and the gripping portion cooperating by complementarity of shape.

8. The writing instrument according to claim 1, wherein the eraser device comprises an eraser holder and an eraser that is carried by the eraser holder.

9. The writing instrument according to claim 1, wherein the eraser device is formed by one and the same part.

10. The writing instrument according to claim 1, wherein the body extends in an axial direction, the writing instrument comprising a writing tip oppositely situated in the axial direction of the eraser device.

11. The writing instrument according to claim 1, wherein the eraser device includes a friction body that is designed to be rubbed against a surface that is coated with thermochromic ink in order to generate heat and cause the thermochromic ink to change color.

12. A writing instrument, having a body, a clip, and a retractable eraser device configured to be moved between a first position and a second position, the clip forming a housing that is designed to receive all or part of a gripping portion of the eraser device when the eraser device is in the first position, wherein the clip has a "V" or "U" shaped portion that forms the housing, wherein the "V" or "U" shaped portion includes a concavity and a guide extending along the concavity, and wherein the gripping portion is received in the concavity of the "V" or "U" shaped portion when the eraser device is in the first position, the concavity being open at an axial end of the body, the guide comprising a channel or axial ribs extending from the first position to the second position corresponding to complementary axial ribs or a complementary channel of the eraser device.

13. The writing instrument of claim 12, wherein the eraser device is monolithically formed as a single part.

14. The writing instrument according to claim 12, wherein the body extends in an axial direction, the eraser device being movable in the axial direction, and the eraser device projecting axially from an axial end of the body when the eraser device is in the second position while not projecting axially from the body when the eraser device is in the first position.

15. The writing instrument according to claim 12, wherein the eraser device is partially retracted into the body in the first position.

16. The writing instrument according to claim 12, wherein the clip and/or the body comprises a guide that is designed to guide the eraser device between the first and second positions, the guide comprising a channel or an at least one axial rib extending from the first position to the second position corresponding to a complementary at least one axial rib or a complementary channel of the eraser device.

17. The writing instrument according to claim 12, wherein the eraser device and/or the clip and/or the body comprises at least one retainer that is designed to retain the eraser device in the first position.

18. The writing instrument according to claim 12, wherein the eraser device and/or the clip and/or the body comprises at least one holder that is designed to maintain the eraser device in the second position.

19. The writing instrument according to claim 12, wherein the eraser device includes a friction body that is designed to be rubbed against a surface that is coated with thermochromic ink in order to generate heat and cause the thermochromic ink to change color.

20. A writing instrument, having a body, a clip, and a retractable eraser device configured to be moved between a first position and a second position, the clip forming a housing that is designed to receive all or part of a gripping portion of the eraser device when the eraser device is in the first position, the clip having a "V" or "U" shaped portion that forms the housing, wherein the "V" or "U" shaped portion includes a concavity, and wherein the gripping portion is received in the concavity of the "V" or "U" shaped portion when the eraser device is in the first position, the concavity being open at an axial end of the body, and the clip and/or the body comprising an opening, an interior wall that extends transversely from a plane of the opening, and a guide that is designed to guide the eraser device between the first and second positions, the guide comprising a channel or an at least one axial rib extending from the first position to the second position corresponding to a complementary at least one axial rib or a complementary channel of the eraser device, wherein the channel or axial ribs extend along the interior wall.

* * * * *